US005927227A

United States Patent [19]

Derby et al.

[11] Patent Number: 5,927,227

[45] Date of Patent: Jul. 27, 1999

[54] HOLLOW CONCRETE-WALLED STRUCTURE FOR MARINE USE

[76] Inventors: Stanley Derby, Elmwood Cottage 16 Southlands Avenue, Southbourne, Bournemouth BH6 4HJ; Anthony Jefferson, University of Wales Cardiff School of Engineering Queens Buildings, Cardiff, CF2 1XH, both of United Kingdom

[21] Appl. No.: 08/981,188

[22] PCT Filed: Jun. 5, 1996

[86] PCT No.: PCT/GB96/01328

§ 371 Date: Apr. 9, 1998

§ 102(e) Date: Apr. 9, 1998

[87] PCT Pub. No.: WO97/00194

PCT Pub. Date: Jan. 3, 1997

[30] Foreign Application Priority Data

Jun. 16, 1995 [GB] United Kingdom ..... 9512258

[51] Int. Cl.[6] ..... B63B 35/44

[52] U.S. Cl. ..... 114/264; 114/65 R

[58] Field of Search ..... 114/355, 65 R, 114/264, 265, 266; 405/222

[56] References Cited

U.S. PATENT DOCUMENTS

| | | | |
|---|---|---|---|
| 1,289,781 | 12/1918 | Hubbell | 114/355 |
| 2,144,939 | 1/1939 | Schiavi | 405/222 |
| 3,081,600 | 3/1963 | Davidon . | |
| 3,537,268 | 11/1970 | Georgii | 114/264 |
| 4,229,497 | 10/1980 | Piazza . | |
| 4,263,862 | 4/1981 | Shepherd . | |

FOREIGN PATENT DOCUMENTS

| | | |
|---|---|---|
| 2 674 899 A1 | 9/1992 | France . |
| 41 34 787 A1 | 4/1993 | Germany . |
| 2 159 468 | 6/1984 | United Kingdom . |

*Primary Examiner*—Stephen Avila
*Attorney, Agent, or Firm*—Workman, Nydegger & Seeley

[57] ABSTRACT

There are disclosed embodiments of hollow-walled structures for marine use, and particularly of form a semi-submersible vessel for use in the off-shore industry. The structure has concrete walls of hollow structure, and void formers are incorporated in at least some of the concrete walls to provide controlled variation in wall density to meet design requirements. In the application of the invention to a semi-submersible vessel, void formers are cast in situ within the concrete walls of upstanding columns of the vessel, and in which the volume and/or distribution of the void formers in the walls varies in such a way that the density of the columns decrease with height above the base.

12 Claims, 10 Drawing Sheets

HOLLOW CONCRETE-WALLED STRUCTURE FOR MARINE USE

This application is a 371 of PCT/6B96/C1328 filed Jun. 5, 1996.

This invention relates to a hollow concrete-walled structure for marine use, and including application in ship-shaped and barge types of floating structure, floating effluent-treatment plant, semi-submersible floating structures, and marine gravity structures for use under water e.g. on the seabed.

Common to all these types of structures will be a hollow concrete-walled structure, and which gives buoyancy in the case of floating and semi-submersible vessels, and also defines storage space for cargo and houses the operating components of the vessel, accommodation for crew and related facilities.

However, the invention is not restricted to floating and semi-submersible vessels, and includes application to fully submerged concrete structures, which will be hollow in order to house operating components of the structure, and to receive and to process material for which the structure has been designed e.g. an off-shore seabed effluent treatment plant. Concrete structures are used in marine environments because of their superior resistance to deterioration in such conditions, when compared with metal structures, but generally are used only in static locations or as permanent fixtures. Examples of use in static locations include massive concrete structures to form oil production platforms, which are fabricated on or near to shore, towed out in a floating mode to the desired location, and then flooded so as to be lowered onto the seabed.

Therefore, while most concrete structures for marine use comprise fixed installations e.g. massive cast concrete quays, jetties etc, it is also known to use concrete in specially designed floating structures, such as oil productions platforms.

However, although internal metal reinforcement is usually provided in the concrete walls of known structures, essentially concrete of the structure is cast as a solid and very substantial mass.

There is a long standing appreciation that concrete is a desirable material to use in marine environments, but to date it has not been practical to use concrete in ship-shaped and similar structures, because of the massive weight of the lining walls and bulkheads of the vessel (when formed of reinforced concrete) and which adds very significantly to the structural weight of the vessel, but in addition this weight applies substantial bending loads to the vessel (in addition to buoyant loads) and which have to be withstood by additional reinforcement at locations of maximum anticipated bending and other stresses.

The invention therefore seeks to provide a hollow concrete-walled structure for marine use, and in which the density of the wall structure can be varied in a controlled and simple manner to suit design requirements while retaining the advantages of providing an outer water-contacting surface which is made of concrete.

The invention therefore provides a structural system which enhances the potential economic and technical advantages of concrete in off-shore structures, and to solve some of the problems associated with the use of conventional reinforced concrete construction techniques for such structures. Problems with such conventional designs include potentially high bending moments associated with large concrete ships and barges, as just referred to, and high differential heads associated with deep draft semi-submersibles for many applications and operating conditions, and also the potential for unseen corrosion of steel reinforcement within such structures, and also concerns with regard to long term fatigue problems.

The invention meets these objectives by incorporating void formers at selected locations in cast concrete walls of the hollow structure, and thereby provides both a novel method of fabrication, and novel structures obtained thereby.

The cast concrete walls of the structural system, incorporating void formers at selected locations, will preferably include metallic or non-metallic internal reinforcement e.g. so-called tensioning tendons, and preferably there is also built in structural self-monitoring.

By varying the amount, size and distribution of void formers throughout the structure, and by varying the thickness of the structure, consistent with maintaining required structural strength, the system permits a variation of density of the concrete walls of the structure at predetermined locations in order to meet particular applications.

The concrete walls form a containment or enclosure of the structure and may take up any desired multi-wall configuration, and with such inherent high strength of a multi-wall configuration and the reduced overall weight, the system permits a greater span between internal bulkheads of a structure than is possible with conventional designs.

The internal reinforcement may comprise pre or post-tensioned elements, and preferably any self-monitoring components are incorporated in the reinforcing material.

Given that cast concrete is very strong in compression, but relatively weak in tension, the tensioning system will compensate for this, and it will usually be desirable additionally to incorporate fibrous fillers into the concrete mixture prior to casting. The use of such fibrous reinforcement is known per se in land based and other fixed building installations of concrete.

The invention therefore may be employed in ship-shaped, barge and semi-submersible floating structures, for multiple purposes including drilling, storage and production of hydrocarbons. In the application to marine gravity structures, for use on the seabed, or river-bed, the structure may be used in the off-shore treatment of effluent.

Preferred embodiments of the invention will now be described in detail, by way of example only, with reference to the accompanying drawings, one of which shows an embodiment of a ship-shaped oil storage vessel, and the others of which show semi-submersibles, and in which.

Figure 5C:
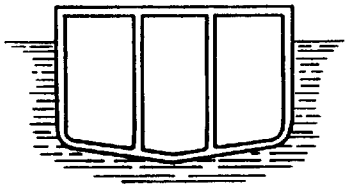
Figure 5A:
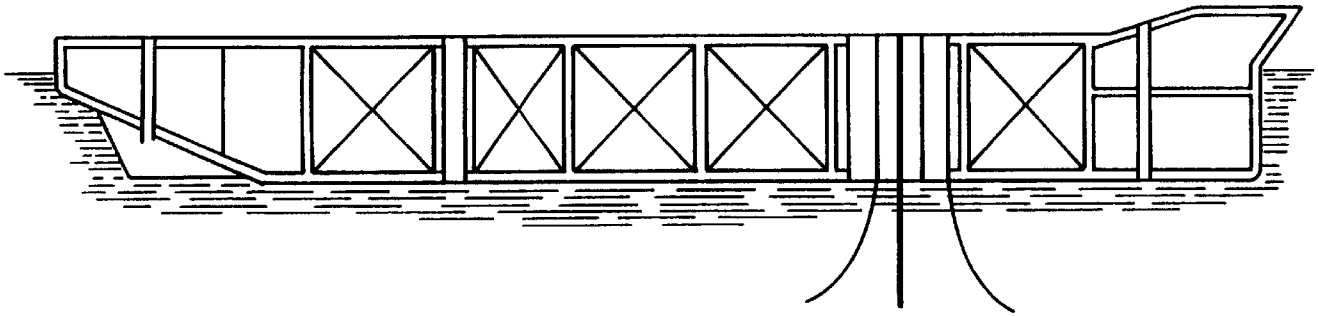
Figure 6A:
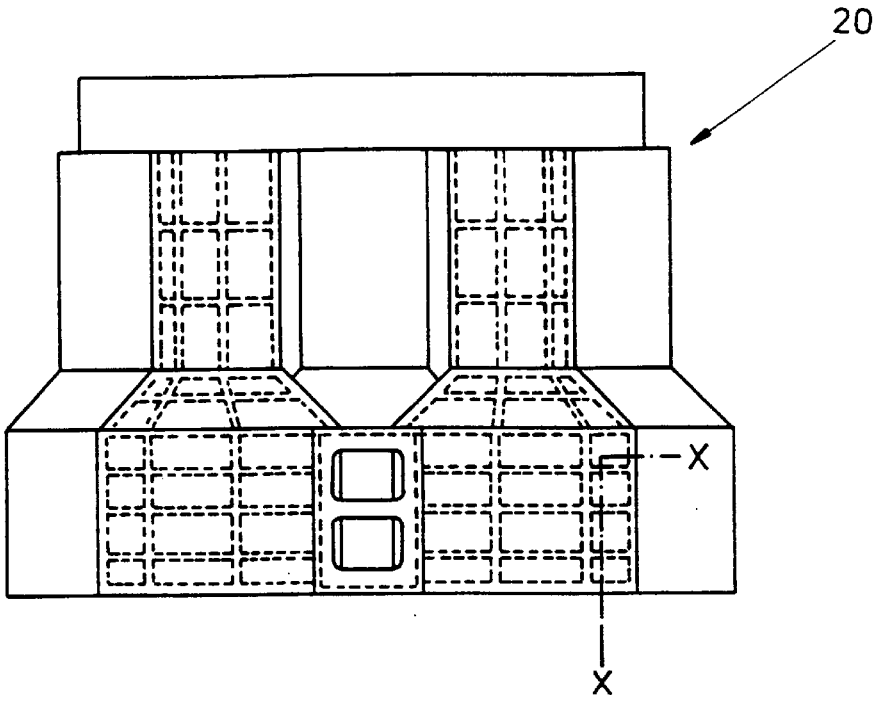
Figure 7:
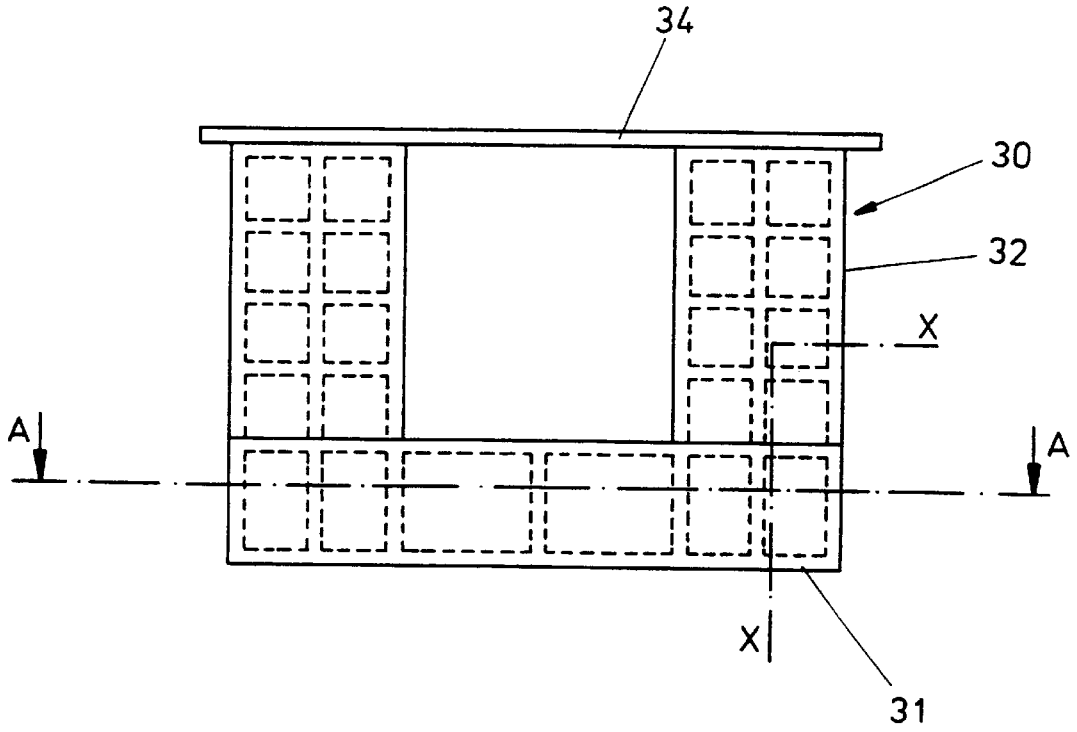
Figure 8:
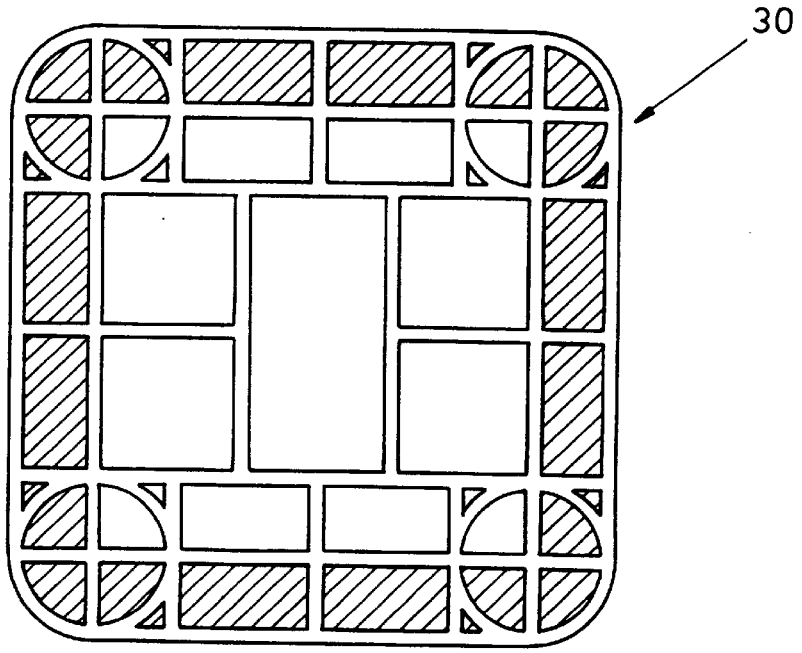
Figure 9:
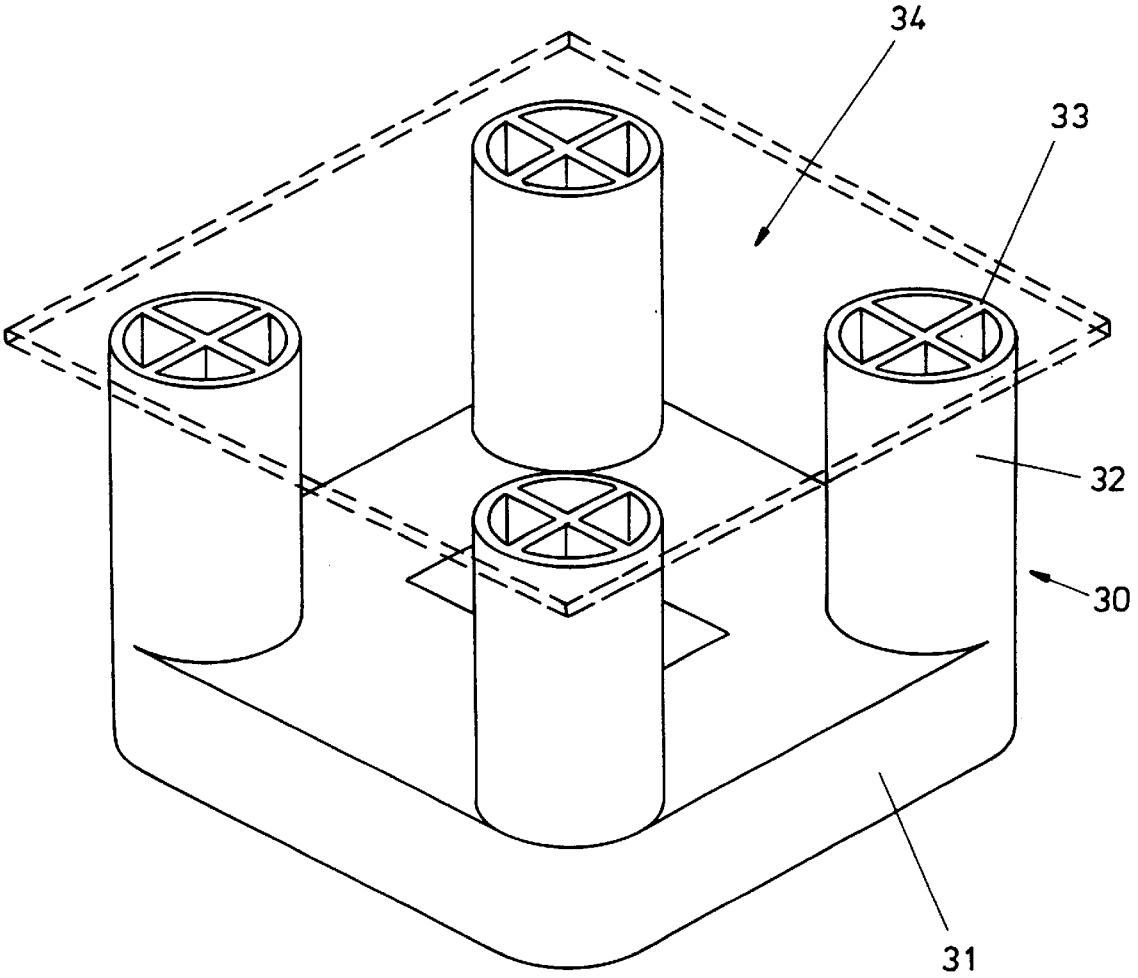
Figure 10:
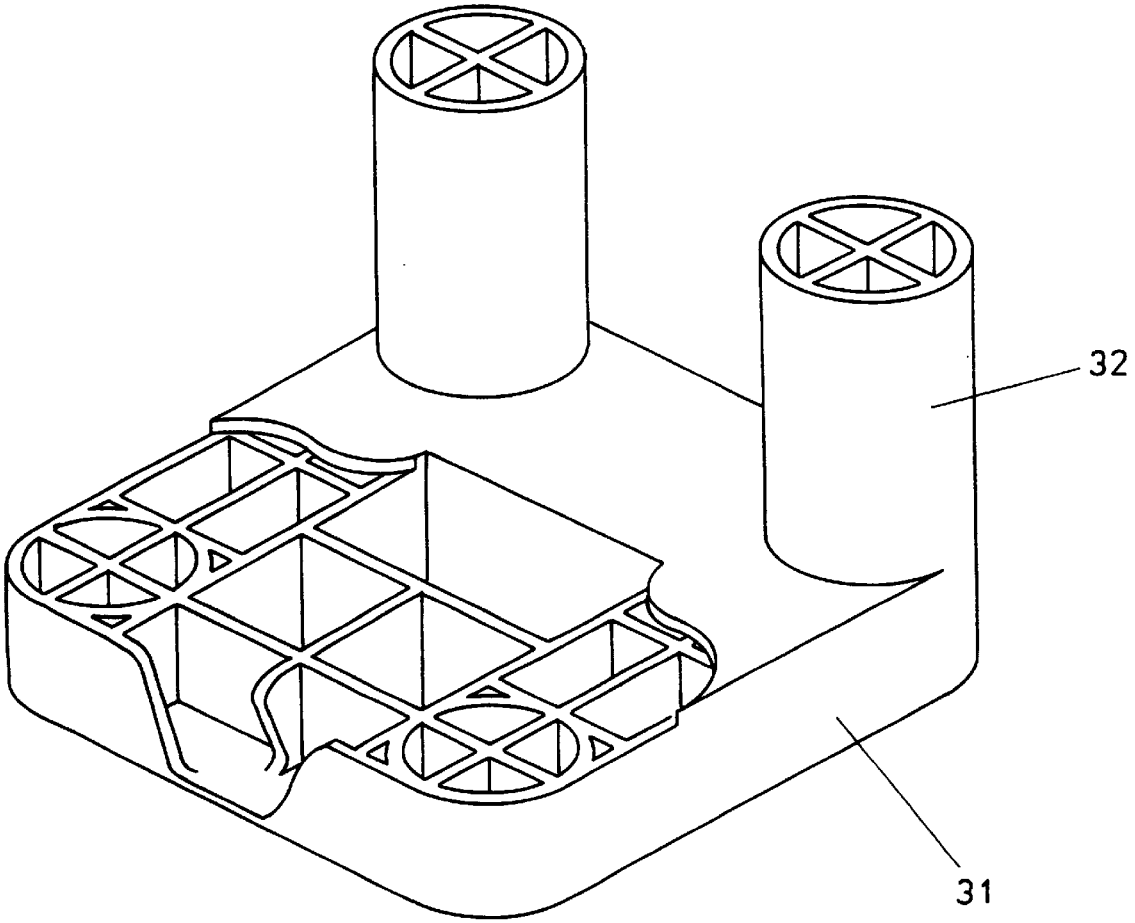
Figure 11:
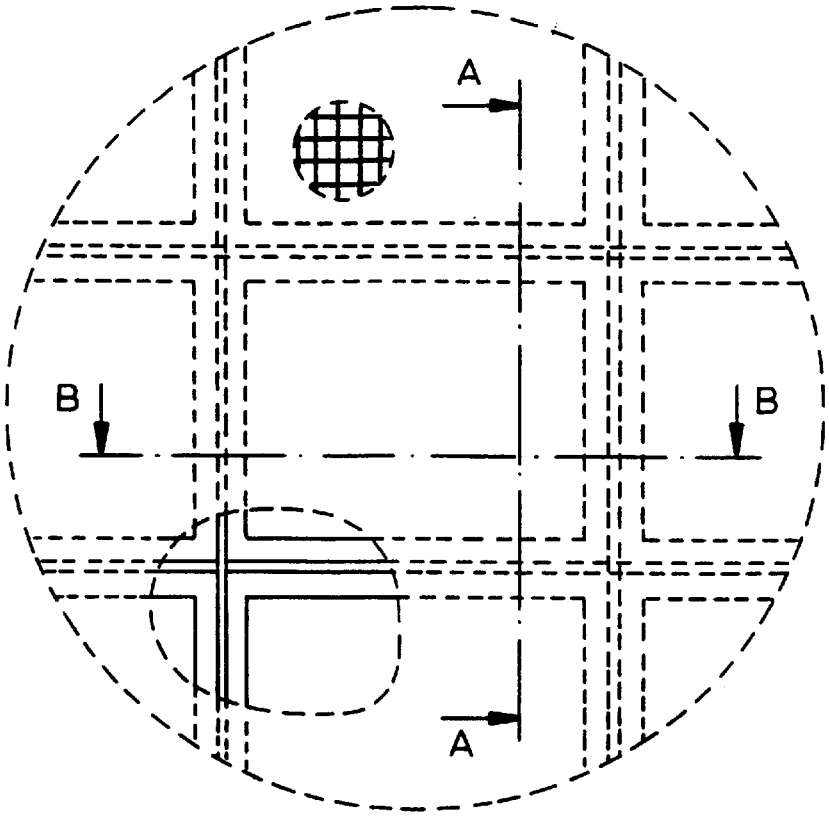
Figure 12:
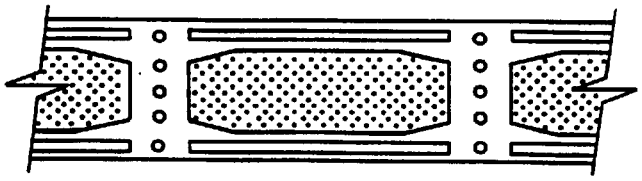
Figure 13:
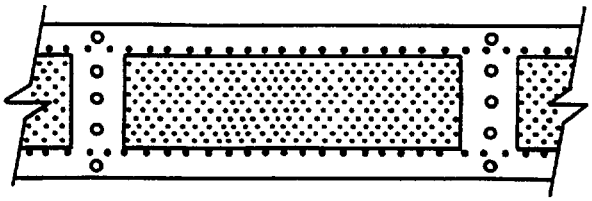

FIGS. 5*a, b* and *c* show, respectively, side view, plan view and end view of an oil storage ship hull general arrangement;

FIGS. 6*a* and *b* show, respectively, elevation and plan views of a semi-submersible general arrangement to which the invention may be applied;

FIG. 7 is an elevation showing in more detail a preferred embodiment of semi-submersible vessel according to the invention;

FIG. 8 is a horizontal sectional view taken on the section line A—A in FIG. 7;

FIG. 9 is a perspective and schematic illustration of the semi-submersible vessel shown in FIGS. 7 and 8;

FIG. 10 is a perspective illustration, similar to FIG. 9, showing the base structure partly broken away to show its internal configuration;

FIG. 11 is a detail view of a typical internal construction of a cast concrete wall structure incorporated in the columns of the semi-submersible vessel shown in FIGS. 7 to 10;

FIG. 12 is a section taken on the line A—A in FIG. 11;

FIG. 13 is a section taken on the line B—B in FIG. 11; and

Figure 14:
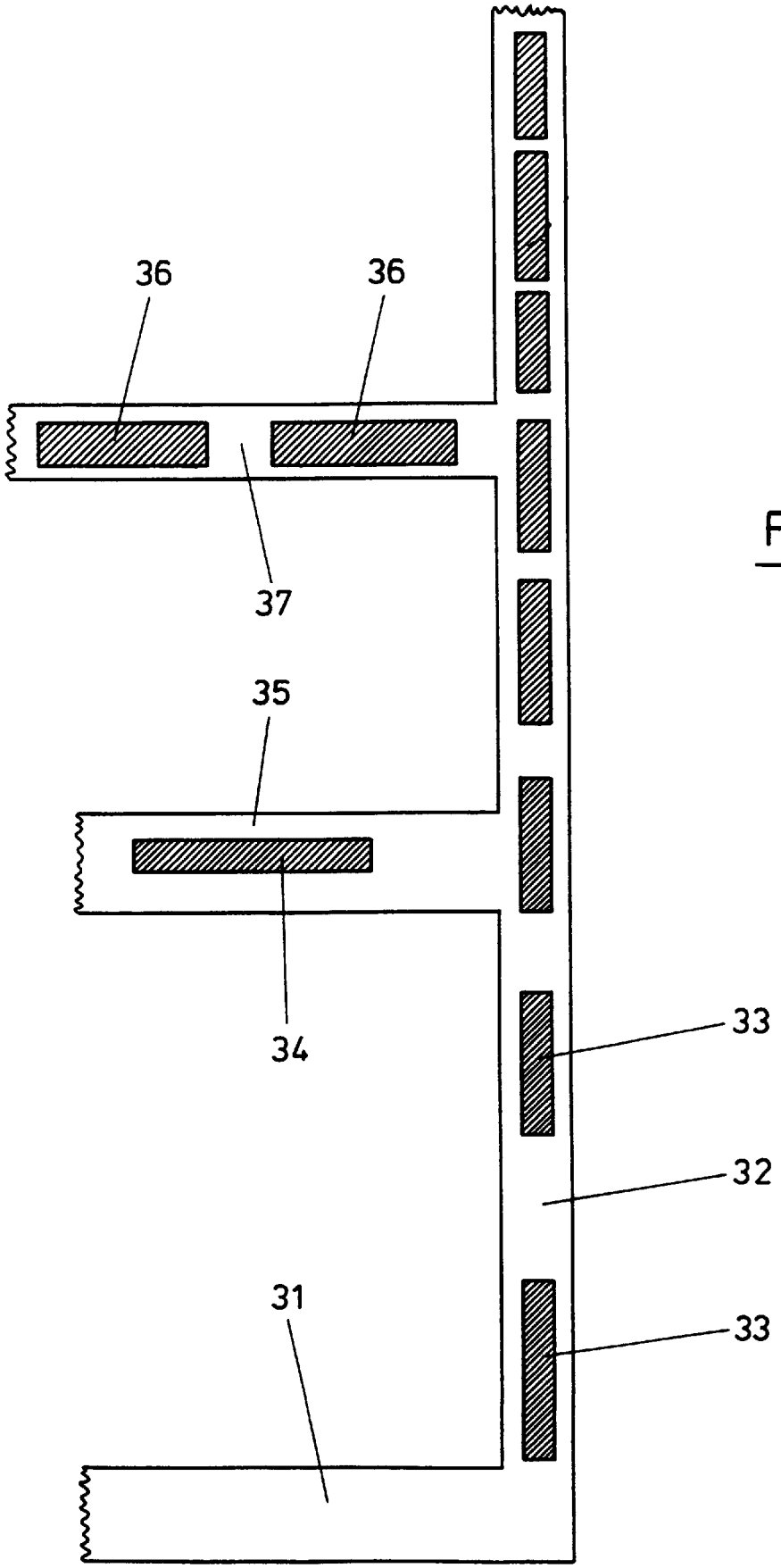

FIG. 14 is a schematic illustration of incorporation of void formers within the cast concrete walls of one of the columns of a semi-submersible, so as to achieve reduction in density of the column with height above the base.

The examples shown in the drawings are schematic only, and for illustrative purposes only, and showing the application of the invention to examples only of hollow concrete-walled structures for marine use.

Although not shown in the drawings, the features of the invention may be applied to a floating effluent-treatment plant, and to marine gravity structures also, for use underwater and e.g. on the seabed for use in the off-shore treatment of effluent.

Figure 1:
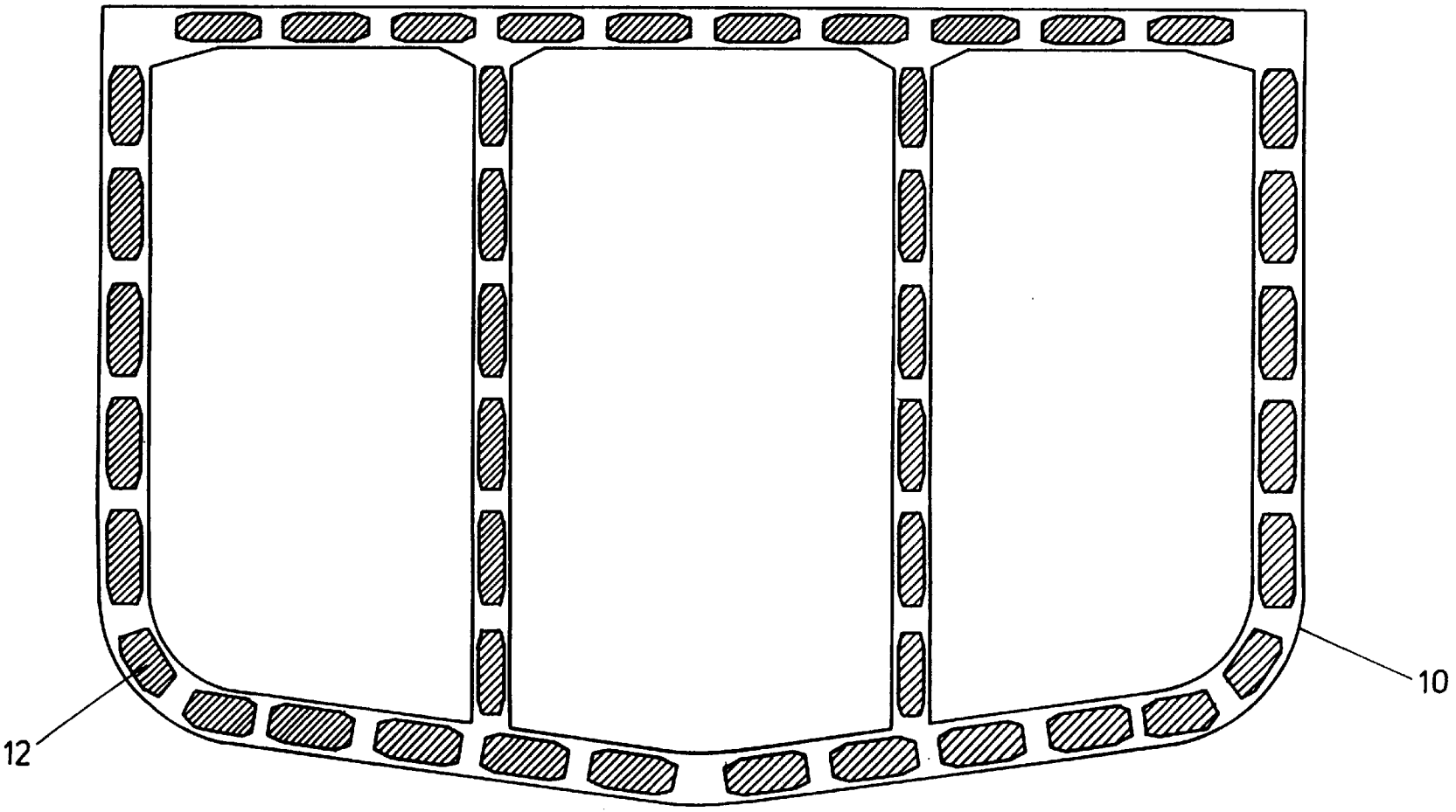
FIG. 1 is a cross-section through a ship-shaped hull.
Figure 2:
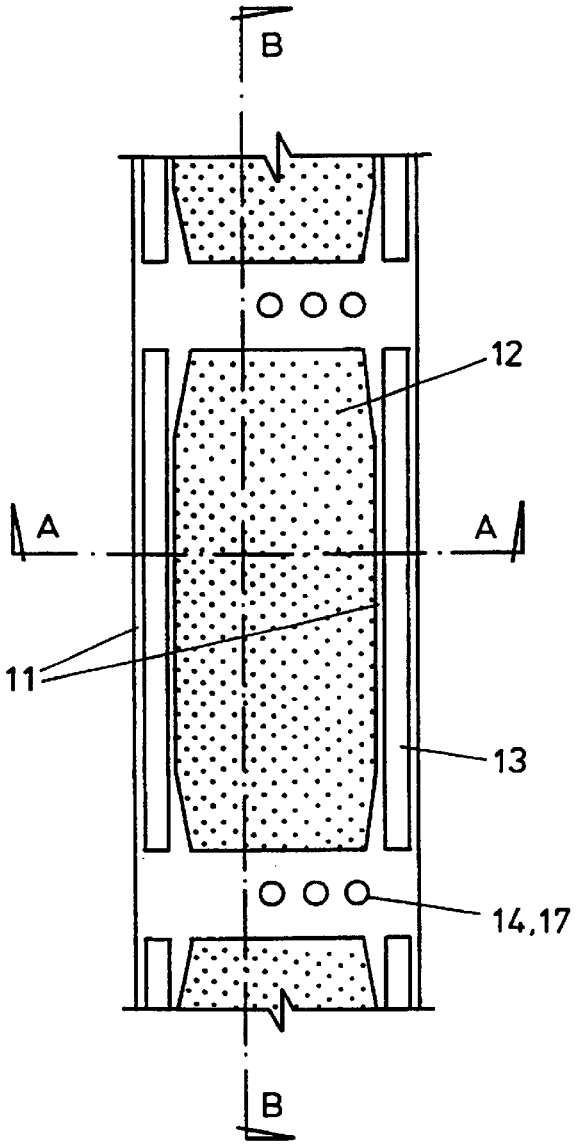
FIG. 2 is a detail view of FIG. 1, to an enlarged scale.
Figure 3:
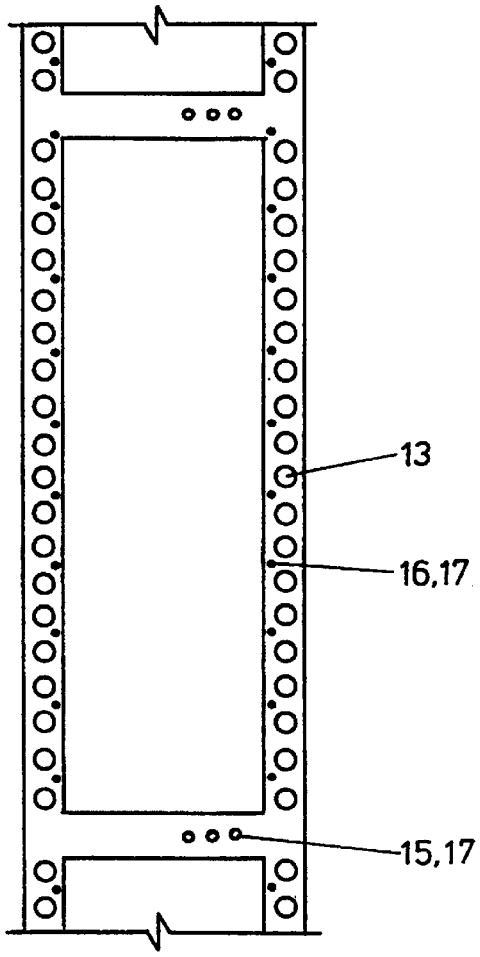
FIG. 3 is a section taken on the line A—A in FIG. 2.

Referring to FIGS. 1 to 3, a concrete structure 10 has a series of main void formers 12 and secondary void formers 13 distributed throughout and which can be of varying size and quantity to, in turn, permit the density of the structure to be varied for example, the bottom of the structure can be heavier than the upper portions, and/or the centre section can be heavier than the end sections.

In FIGS. 2 and 3, an arrangement of typical structural sections shows double walls 11, main void formers 12, secondary void formers 13, main longitudinal tensioning tendons 14, main vertical or transverse tensioning tendons 15, secondary tensioning tendons 16 and an in-built fibre optic, or equivalent, monitoring system 17. The structural section can be of any shape to suit the configuration of the structure and can have a multiple wall section rather than the double wall section illustrated herein.

Figure 4:
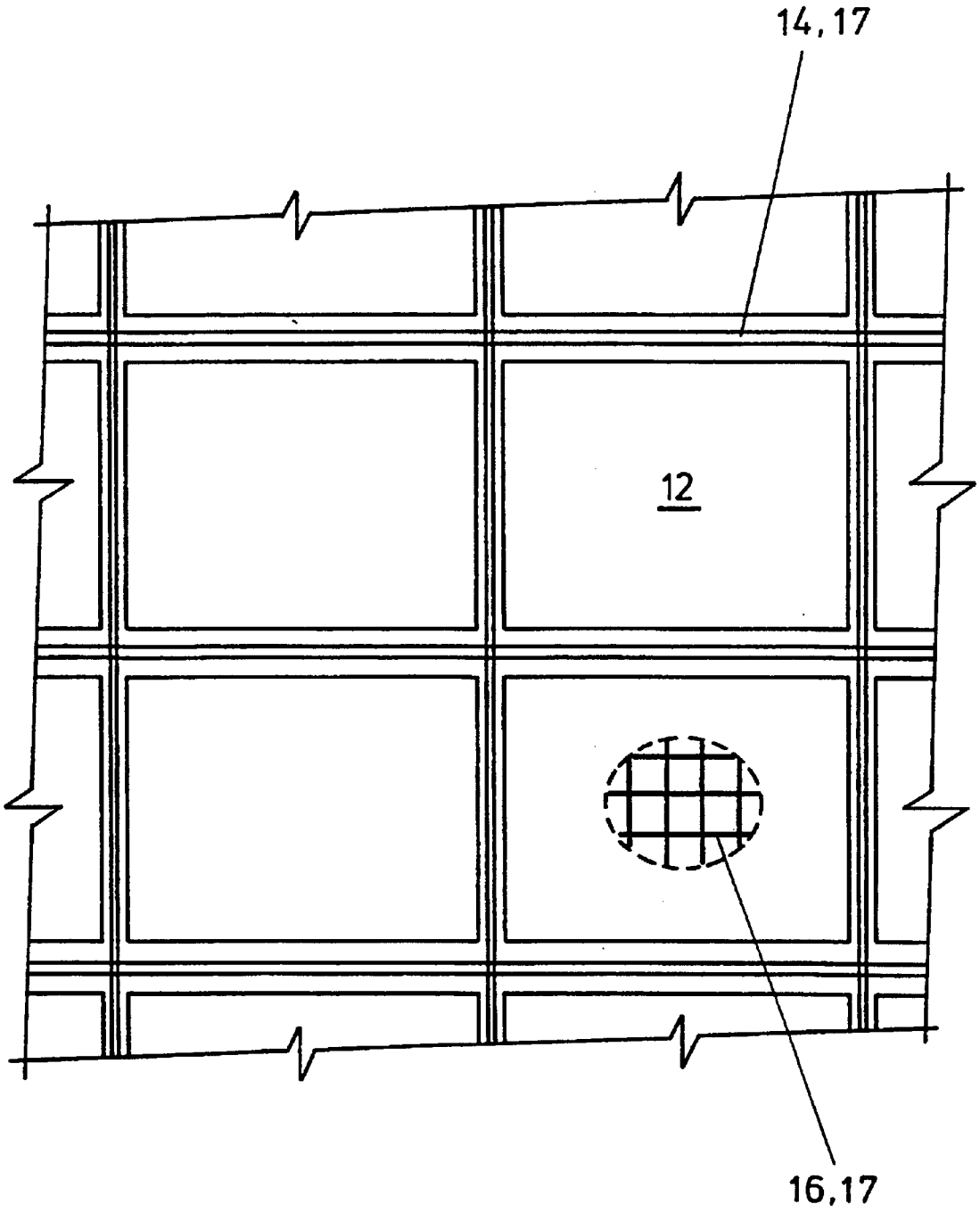
FIG. 4 is a typical structural part plan or side elevation taken on section line B—B in FIG. 2.

FIG. 4 shows one typical structural part plan or side elevation with main void formers 12, main longitudinal tensioning tendons 14, secondary tensioning tendons 16 and an in-built fibre optic, or equivalent, monitoring system 17.

Figure 5B:
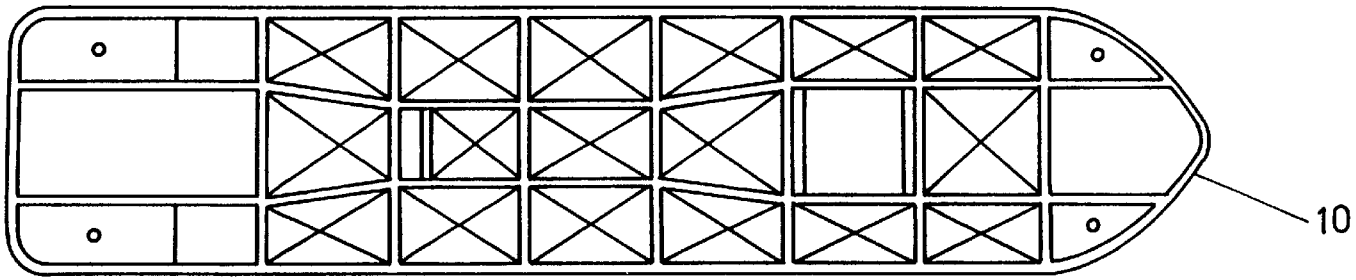

The oil storage ship hull in FIG. 5 shows one application for the invention. Such a structure 10, designed to store say one million barrels of oil, could be 250 meters long or more so that the ability to vary the density of the hull, and hence its weight, in different locations, and to reduce the number of internal bulkheads, consistent with maintaining structural integrity, permits the major bending moments experienced at the midship section to be readily contained within safe design limits.

Figure 6B:
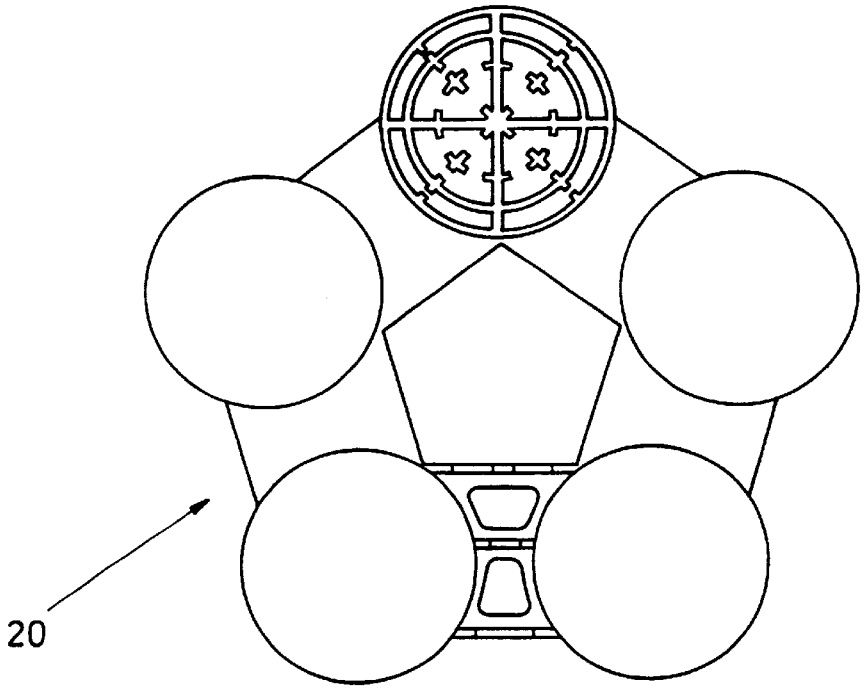

The semi-submersible illustrated in FIGS. 6*a* and 6*b* shows another application for the invention. The designing of such a structure, designated generally by reference 20, is again required to store say one million barrels of oil and to have a segregated water ballast capability and to have a deck load capability in excess of 50,000 tonnes, and is greatly assisted by the ability to vary the density of the hull in different locations and to maximise the span between internal bulkheads. The ability of the invention to permit significant structural weight reductions, and to enable accurate weight distribution, is significant in balancing the naval architectural requirements within safe structural design limits. The invention permits significant reductions in the draft of such a vessel and hence reductions in the differential hydrostatic head to which the lower compartments could be subjected where some are required to be empty.

Although the description and drawings of preferred embodiment of the invention refer to metallic and non-metallic tendons to form all or part of the internal reinforcement of the concrete walls of the structure, it should be understood that other types of concrete reinforcement materials may be used as an addition, or alternative to the tendons, and including use of non-metallic mesh.

The invention is particularly suitable for application in a semi-submersible vessel for use in the off-shore exploitation of below-seabed fluid hydrocarbon reserves, and in which the vessel comprise a massive base; hollow columns secured to and projecting upwardly from the base, and the columns having cast concrete walls; a superstructure supported by the columns; void formers cast in situ within the concrete walls of the columns; and in which the volume and/or distribution of the void formers in the walls of at least one of the columns varies in such a way that the density of the column decreases with height above the base.

Desirably, the volume and/or distribution of the void formers of all of the columns varies in such a way that the density of all of the columns decrease with height above the base.

The cast concrete walls are upwardly extending walls, which in the illustrated embodiment comprise generally annular walls.

The cast concrete columns also usually will include transverse concrete walls, and preferably the variable volume and/or distribution of the void formers includes controlled distribution of the void formers in the transverse concrete walls, which are spaced apart throughout the height of one or more of the columns.

Desirably, the massive base is made of cast concrete, and void formers may also be cast in situ in the base.

To provide for storage of liquid hydrocarbons, and subsequent discharge to tankers, the base will usually incorporate ballast tanks and liquid hydrocarbon storage tanks.

As in the previously described embodiments, non-metallic reinforcement is arranged within at least some of the concrete walls to increase the resistance to tensile load, and comprises tensioning tendons, at least one of which has a built-in self-monitoring device to monitor the structural integrity of the wall structure in service.

By use of lightweight tensioning tendons e.g. of fibre glass, plus the feature of variation of the density of the columns with height (this does not need to be an exactly proportional relationship), relatively lightweight, but sufficiently strong columns can be provided, while the overall configuration and the massive base provides stability to the vessel.

Further embodiments of the invention will be described in more detail below with reference to FIGS. 7 to 14, but first there will be given general information with regard to the technical construction, and the advantages achieved.

Thus, while the invention is particularly pertinent to a semi-submersible vessel, it should be understood that it also has relevance to any floating structure.

The ability to vary and control the density or weight of different portions of a semi-submersible, by varying the volume of void formers, in concert with the use of lightweight, non-metallic materials as tendons and/or reinforcement, permits a lower centre of gravity for the semi-submersible, and an enhanced super structure (deck) carrying capability.

Using a lightweight shell structural design, it is theoretically possible to design the upper portions of the vessel to have a specific gravity of less than 1 i.e. to be capable of floating in sea water, whilst still maintaining the necessary structural strength.

The very thick double wall shell construction, typically on a 2 meter thick concrete base floor, and 1.5 meter vertical walls in the base, plus the upstanding columns, permits the design of a very strong and rigid structure with long spans between bulkheads, typically 15 to 20 meters, which in turn permits the most efficient use of the smooth and frame-less base tanks for oil storage and ballast.

The design permits a particularly low "float-out" draft during construction which, in certain instances, can permit a structure to be completed in dry dock up to the tops of the columns, prior to float-out. This is generally not possible with current concrete designs which have to be completed at a deep "wet site" after float-out of the base.

Using the proposed lightweight, non-metallic materials also provides the ability to offer a low maintenance structure which will not corrode, and which will be self-monitored over its long life time for additional operator confidence. Potential corrosion in the lower portions of deep draft floating structures is a major concern to operators in off-shore environments e.g. the north sea, so that the ability to eliminate the problem is a considerable advantage.

Referring now to FIGS. 7 to 14, there are shown further preferred embodiments of the invention in the form of semi-submersible vessels. The vessel is designated generally by reference 30, and comprises a massive base 31, preferably of cast concrete, and hollow columns 32 secured to and projecting upwardly from the base 30. The columns 32 have cast concrete walls, and which in the illustrated embodiments comprise generally annular walls 33, and which also have transverse, and also vertically extending internal walls, as illustrated. A superstructure 34, comprising a deck, is supported by the columns 32, and will support necessary ancillary equipment (not shown) appropriate to the particular operations to be carried out by the semi-submersible.

As in the previously describes embodiments, void formers are cast in situ within the concretes wall of the columns, and the volume and/or distribution of the void formers in the walls is varied in such a way that the density of the columns decrease with height above the base.

FIGS. 11 to 13 show typical arrangement of the void formers, and reinforcing tendons, and FIG. 14, which is a cross-section taken on section line X—X in FIG. 7, shows one example only of the way in which the void formers can be distributed.

Thus, as shown in FIG. 14, void formers 33 are shown cast-in situ within the annular walls of the column, and it can be seen that the spacing apart of the void formers 33 reduces with height above the base 31, whereby to cause progressive reduction in the density of the composite structure.(cast concrete wall plus void formers). There is also shown, by way of example, a small volume void former 34 in a transverse connecting wall 35, and larger volume void formers 36 in a higher transverse wall 37.

The arrangement shown in FIG. 14 is by way of example only, and illustrates how void formers can be used to control the weight distribution of the floors and walls of the structure. This is particularly important in semi-submersible type structures, where it may be an advantage to have no void formers in the base, and an increasingly larger number of void formers with increasing height above the base.

The base structure incorporates ballast and hydrocarbon storage tanks, as shown particularly in FIG. 8.

We claim:

1. A semi-submersible vessel for use in the off-shore exploitation of below-seabed fluid hydrocarbon reserves, said vessel comprising:

a massive base;

hollow columns secured to, and projecting upwardly from said base, said columns having cast concrete walls;

a superstructure supported by the columns;

void formers cast in situ within the concrete walls of the columns;

in which the volume and/or distribution of the void formers in the walls of at least one of said columns varies in such a way that the density of said one column decreases with height above said base.

2. A vessel according to claim 1, in which the volume and/or distribution of the void formers in the walls of all of said columns varies in such a way that the density of said columns decrease with height above said base.

3. A vessel according to claim 1, in which said cast concrete walls are upwardly extending walls.

4. A vessel according to claim 3, in which the upwardly extending walls comprise generally annular walls.

5. A vessel according to claim 1, in which the variable volume and/or distribution of void formers includes controlled distribution of at least some of the void formers in transverse concrete walls spaced apart throughout the height of one or more of said columns.

6. A vessel according to claim 1, in which the massive base is made of cast concrete.

7. A vessel according to claim 6, in which void formers are cast in situ in said base.

8. A vessel according to claim 1, in which ballast tanks and liquid hydrocarbon storage tanks are accommodated in said base.

9. A vessel according to claim 1, including non-metallic reinforcement arranged within at least some of the concrete walls to increase the resistance to tensile load.

10. A vessel according to claim 9, in which the reinforcement comprises tensioning tendons, at least one of which has a built-in self-monitoring device to monitor the structural integrity of the wall structure in service.

11. A vessel according to claim 1, in which the superstructure comprises a deck normally supported above the surface of the water by the columns.

12. A vessel according to claim 11, in which the deck incorporates means for carrying out drilling, storage or production of hydrocarbons.

* * * * *